US007121498B1

(12) United States Patent
Black

(10) Patent No.: US 7,121,498 B1
(45) Date of Patent: Oct. 17, 2006

(54) ELONGATE MATERIAL DISPENSER SYSTEM

(75) Inventor: Charles D. Black, Williston, ND (US)

(73) Assignee: New Products Marketing Corporation, Williston, ND (US)

( * ) Notice: Subject to any disclaimer, the term of this patent is extended or adjusted under 35 U.S.C. 154(b) by 369 days.

(21) Appl. No.: 10/602,199

(22) Filed: Jun. 23, 2003

(51) Int. Cl.
*B65H 75/40* (2006.01)

(52) U.S. Cl. ..... 242/588.2; 242/405.2

(58) Field of Classification Search ..... 242/405, 242/405.1, 405.2, 405.3, 588, 588.1, 588.2, 242/609.3, 597.1
See application file for complete search history.

(56) References Cited

U.S. PATENT DOCUMENTS

| | | | | |
|---|---|---|---|---|
| 1,825,822 | A | 10/1931 | Rundell | |
| 2,171,648 | A | 9/1939 | Ennis et al. | 242/55.2 |
| 2,632,605 | A | 3/1953 | Lee | 242/55.2 |
| 3,346,208 | A | 10/1967 | Hoffman et al. | 242/55.2 |
| 3,347,485 | A | 10/1967 | Bundschuh | 242/68.3 |
| 3,612,423 | A | 10/1971 | Bahnsen | 242/55.42 |
| 4,235,389 | A | 11/1980 | Ness | 242/55.2 |
| 5,328,115 | A | 7/1994 | Samuelson et al. | 242/588.6 |
| 5,370,339 | A | 12/1994 | Moody et al. | 242/597.6 |
| 5,664,739 | A | 9/1997 | Black | 242/588.2 |
| 5,683,058 | A | 11/1997 | Schwarz et al. | 242/278.2 |
| 5,927,635 | A | 7/1999 | Black | 242/395 |
| 6,286,777 | B1 * | 9/2001 | Black | 242/388.6 |
| 6,398,150 | B1 * | 6/2002 | Munter et al. | 242/405.2 |
| 6,659,390 | B1 * | 12/2003 | Black | 242/588.2 |

* cited by examiner

*Primary Examiner*—John Q. Nguyen
*Assistant Examiner*—Sang Kim
(74) *Attorney, Agent, or Firm*—Michael S. Neustel

(57) ABSTRACT

An elongate material dispenser system for providing a positive locking structure for retaining a disposable spool regardless of the physical state of the spool's cardboard core. The elongate material dispenser system includes a handle member having a handle shoulder, a handle shank having a first prong and a second prong extending from the handle member, an end member having an end shoulder, a tongue member having a plurality of first teeth and a plurality of second teeth, a first cross member having a first positive member, and a second cross member having a second positive member. The first positive member and the second positive member catchably engage the second teeth within the tongue member. The resilient prongs retain the first positive member and the second positive member in engagement with the second teeth regardless of the physical state of the core.

18 Claims, 11 Drawing Sheets

ELONGATE MATERIAL DISPENSER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to elongate material dispensers and more specifically it relates to an improved elongate material dispenser system for providing a positive locking structure for retaining a disposable spool regardless of the physical state of the spool's cardboard core.

2. Description of the Related Art

Elongate material dispensers using disposable spools have been in use for years. Conventional elongate materially dispensers are formed for receiving and dispensing a disposable spool of material such as barricade tape, flagging tape, construction string, rope, wire and other elongate materials.

U.S. Pat. No. 5,664,739 illustrates an elongate material dispenser that utilizes a split shank design for receiving the disposable spool. The main shank has a plurality of gripping ridges that a pair of prong members engage on opposing sides thereof. When the disposable spool is positioned upon the split shank, the tubular cardboard core of the disposable spool compresses the distal hooked ends of the prong members against the gripping ridges. However, after the disposable spool has become wet or utilized for extended periods of time, the cardboard core begins to deteriorate and deform. After the tubular cardboard core has become deformed, the compression force applied to the prong members is reduced thereby allowing accidental release of the main shank from the prong members.

Examples of patented devices which are related to the present invention include U.S. Pat. No. 5,927,635 to Black; U.S. Pat. No. 2,171,648 to Ennis et al.; U.S. Pat. No. 1,825,822 to Rundell; U.S. Pat. No. 4,235,389 to Ness; U.S. Pat. No. 5,328,115 to Samuelson et al.; U.S. Pat. No. 2,632,605 to Lee; U.S. Pat. No. 5,370,339 to Moody et al.; U.S. Pat. No. 3,346,208 to Hoffman et al.; U.S. Pat. No. 5,683,058 to Schwarz et al.; U.S. Pat. No. 3,347,485 to Bundschuh; and U.S. Pat. No. 3,612,423 to Bahnsen.

While these devices may be suitable for the particular purpose to which they address, they are not as suitable for providing a positive locking action for retaining a disposable spool. Conventional elongate material dispensers are not efficient in unloading/loading disposable spools and are susceptible to accidental release of disposable spools.

In these respects, the elongate material dispenser system according to the present invention substantially departs from the conventional concepts and designs of the prior art, and in so doing provides an apparatus primarily developed for the purpose of providing a positive locking action for retaining a disposable spool.

BRIEF SUMMARY OF THE INVENTION

In view of the foregoing disadvantages inherent in the known types of elongate material dispensers now present in the prior art, the present invention provides a new elongate material dispenser system construction wherein the same can be utilized for providing a positive locking structure for retaining a disposable spool regardless of the physical state of the spool's cardboard core.

The general purpose of the present invention, which will be described subsequently in greater detail, is to provide a new elongate material dispenser system that has many of the advantages of the elongate material dispensers mentioned heretofore and many novel features that result in a new elongate material dispenser system which is not anticipated, rendered obvious, suggested, or even implied by any of the prior art elongate material dispensers, either alone or in any combination thereof.

To attain this, the present invention generally comprises a handle member having a handle shoulder, a handle shank having a first prong and a second prong extending from the handle member, an end member having an end shoulder, a tongue member having a plurality of first teeth and a plurality of second teeth, a first cross member having a first positive member, and a second cross member having a second positive member. The first positive member and the second positive member catchably engage the second teeth within the tongue member. The resilient prongs retain the first positive member and the second positive member in engagement with the second teeth regardless of the physical state of the core.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide an elongate material dispenser system that will overcome the shortcomings of the prior art devices.

A second object is to provide an elongate material dispenser system for providing a positive locking structure for retaining a disposable spool regardless of the physical state of the spool's cardboard core.

Another object is to provide an elongate material dispenser system that is capable of loading/unloading a disposable spool of elongate material.

An additional object is to provide an elongate material dispenser system that is capable of receiving various sizes of disposable spools.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 9:
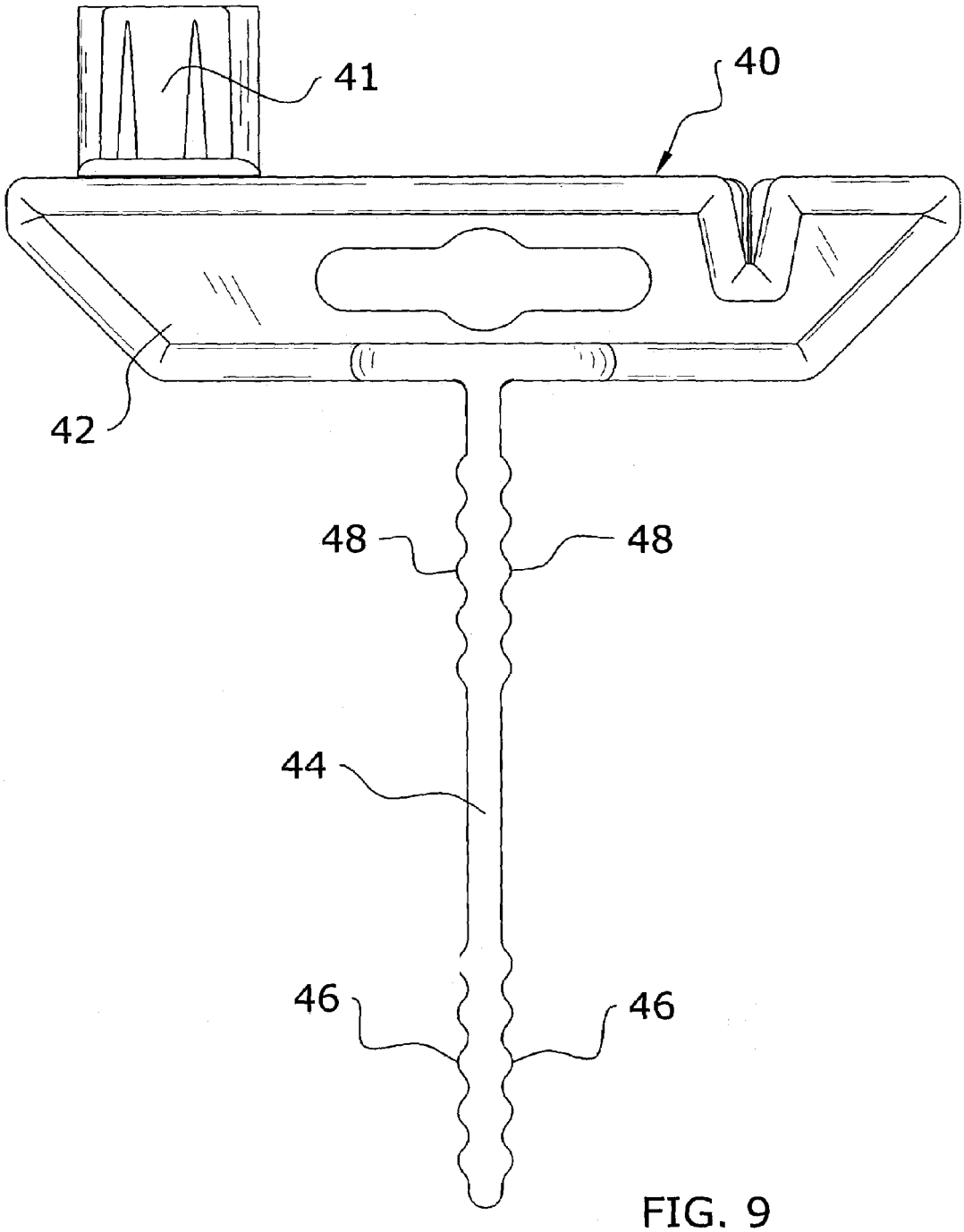
FIG. 9 is a side view of the end member.
Figure 10:
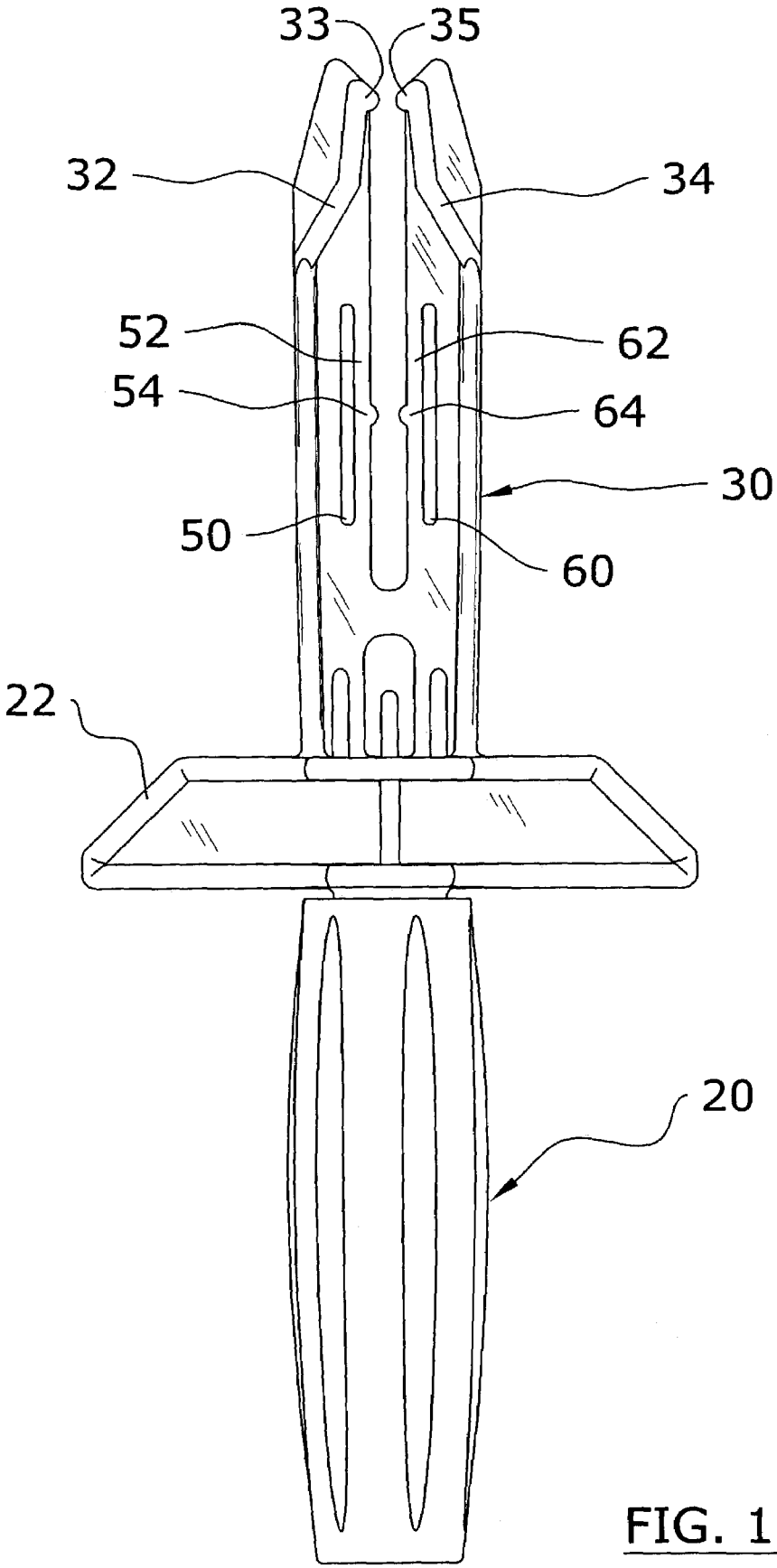
FIG. 10 is a side view of the handle member.
Figure 11:
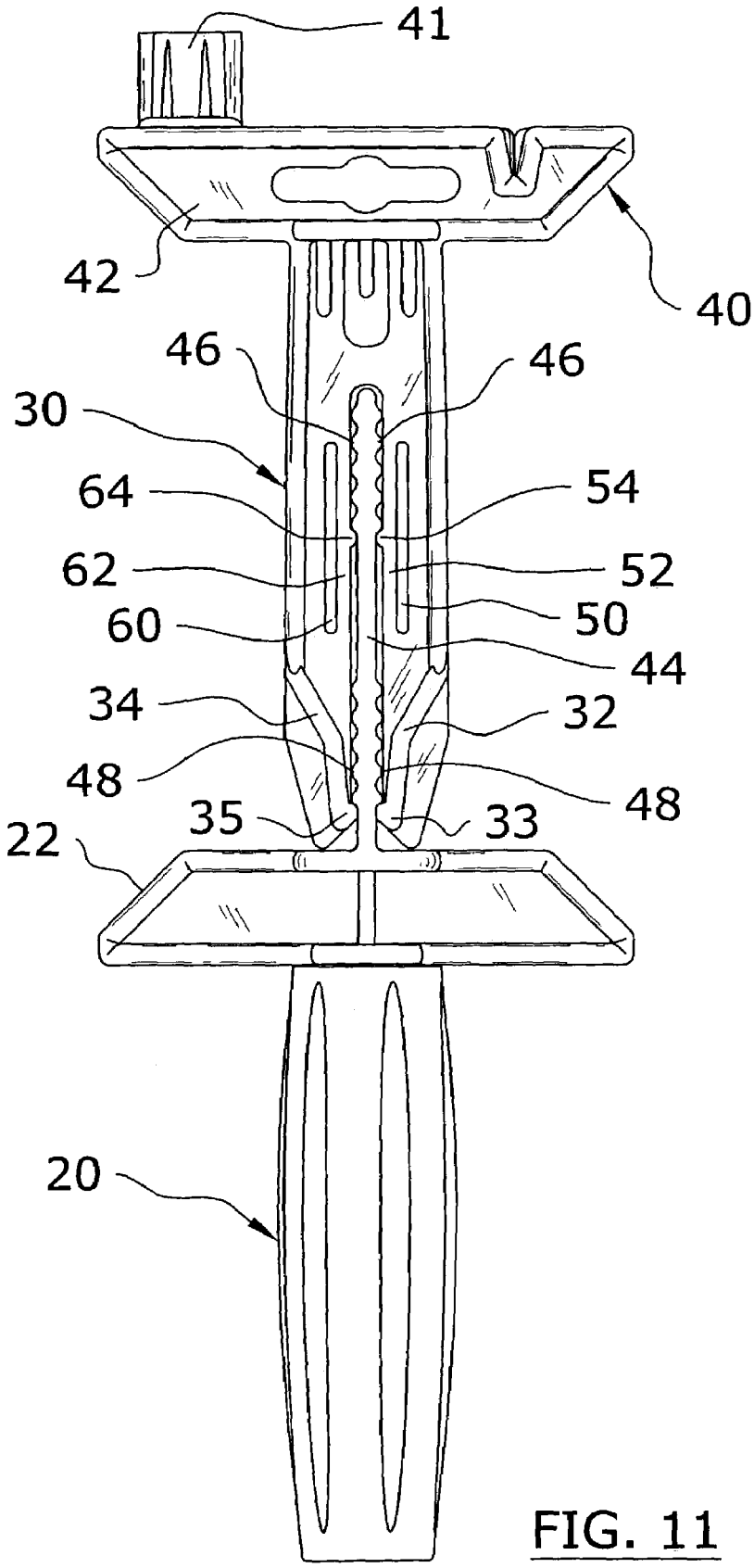
FIG. 11 is a front view of an alternative embodiment of the present invention fully assembled.

Turning now descriptively to the drawings, in which similar reference characters denote similar elements throughout the several views, FIGS. 1 through 11 illustrate an elongate material dispenser system 10, which comprises a handle member 20 having a handle shoulder 22, a handle shank 30 having a first prong 32 and a second prong 34 extending from the handle member, 20, an end member 40 having an end shoulder 42, a tongue member 44 having a plurality of first teeth 46 and a plurality of second teeth 48, a first cross member 52 having a first positive member 54, and a second cross member 62 having a second positive member 64. The first positive member 54 and the second positive member 64 catchably engage the second teeth 48 within the tongue member 44. The resilient prongs retain the first positive member 54 and the second positive member 64 in engagement with the second teeth 48 regardless of the physical state of the core 14. The structure of the present invention may be reverse with the prongs 32, 34 extending from the end member 40 instead of the handle member 20 as shown in FIG. 11.

B. End Member

Figure 4:
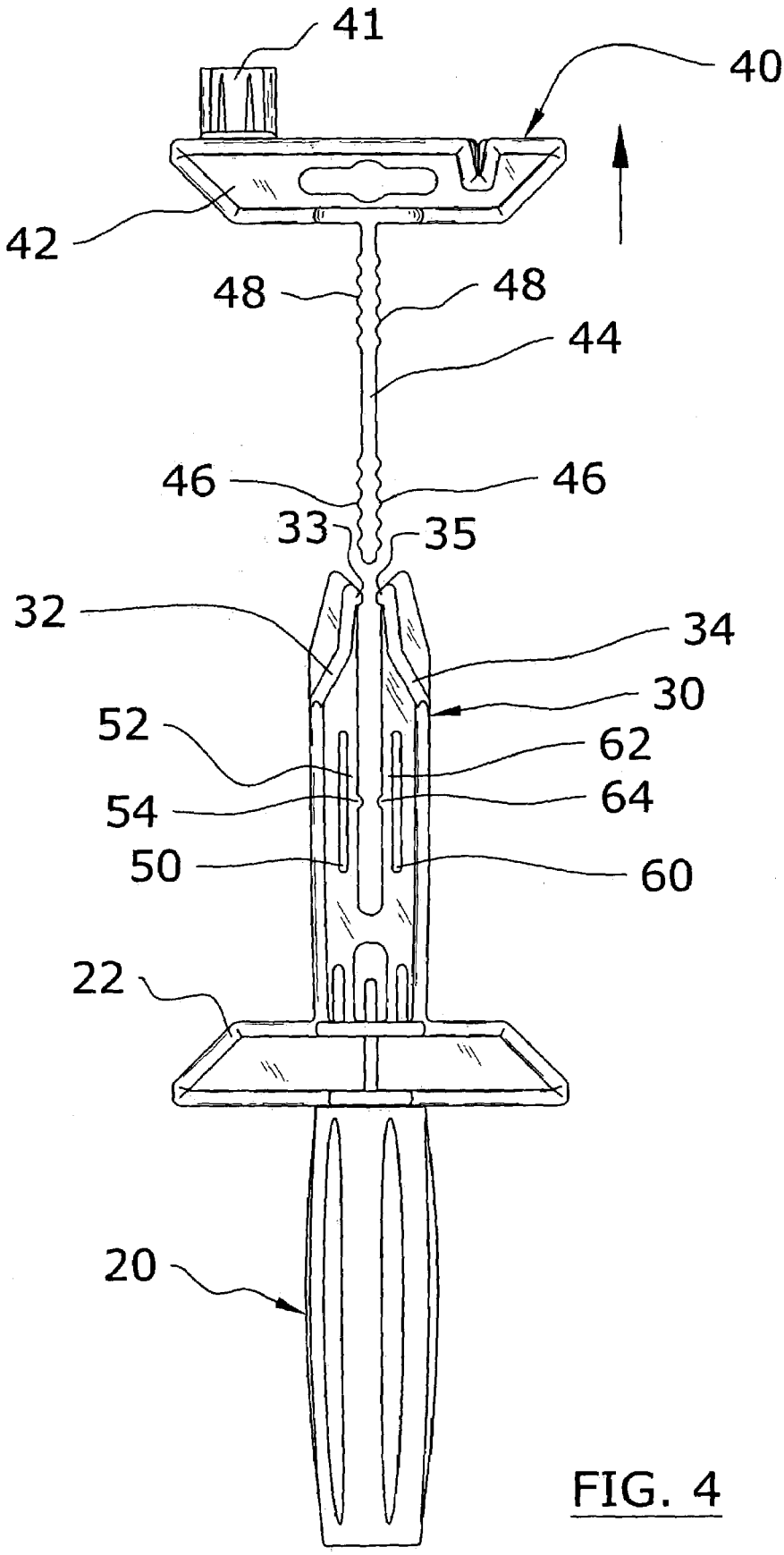
FIG. 4 is a front view of the present invention with the split shank fully separated.
Figure 5:
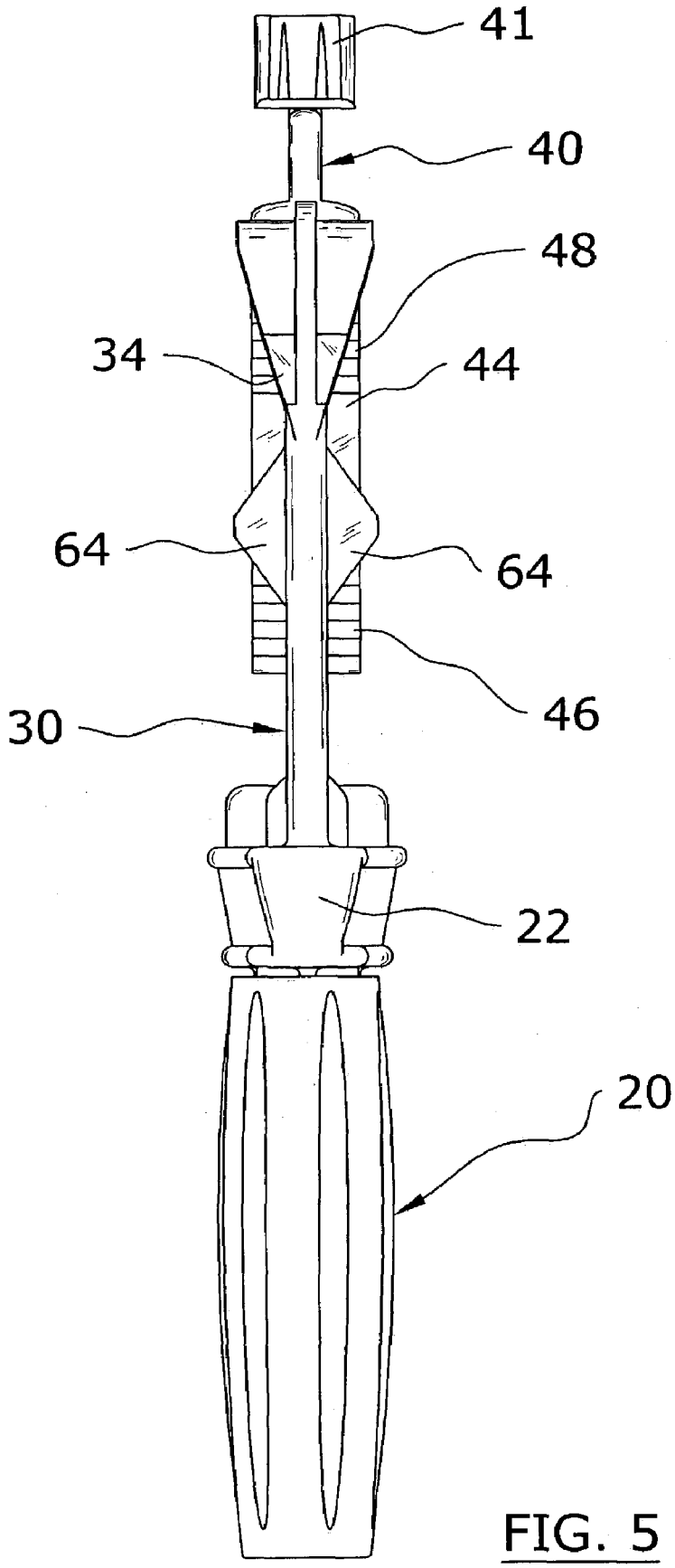
FIG. 5 is a side view of the present invention fully assembled.

The end member 40 is removably connected to the handle member 20 thereby forming a shank structure that extends through the core 14 of a spool 12 of elongate material such as line, string or tape. The end member 40 includes a tongue member 44 extending from an end shoulder 42 as best shown in FIGS. 4 and 9 of the drawings.

Figure 7:
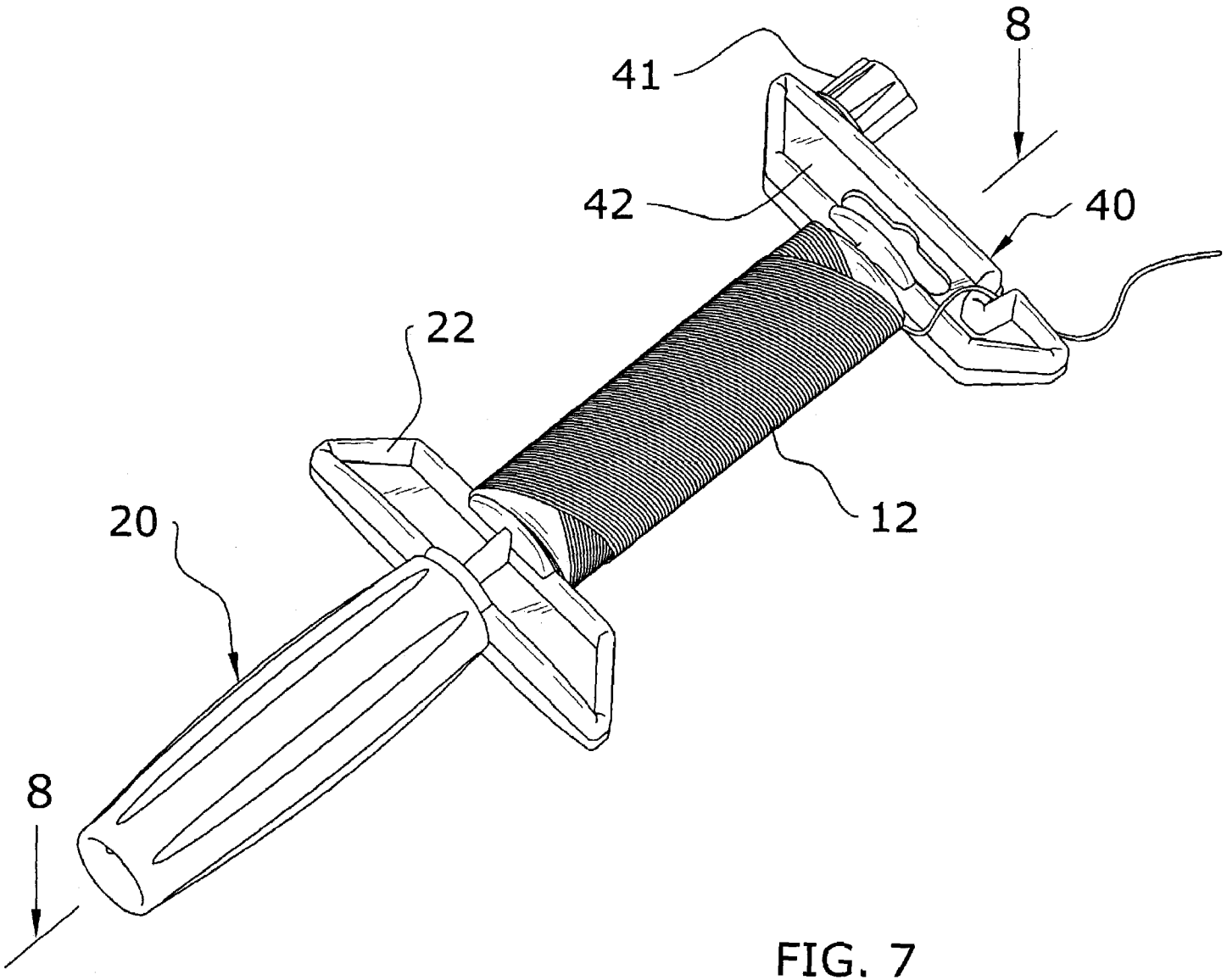
FIG. 7 is an upper perspective view of the present invention fully assembled with a disposable spool attached.
Figure 8:
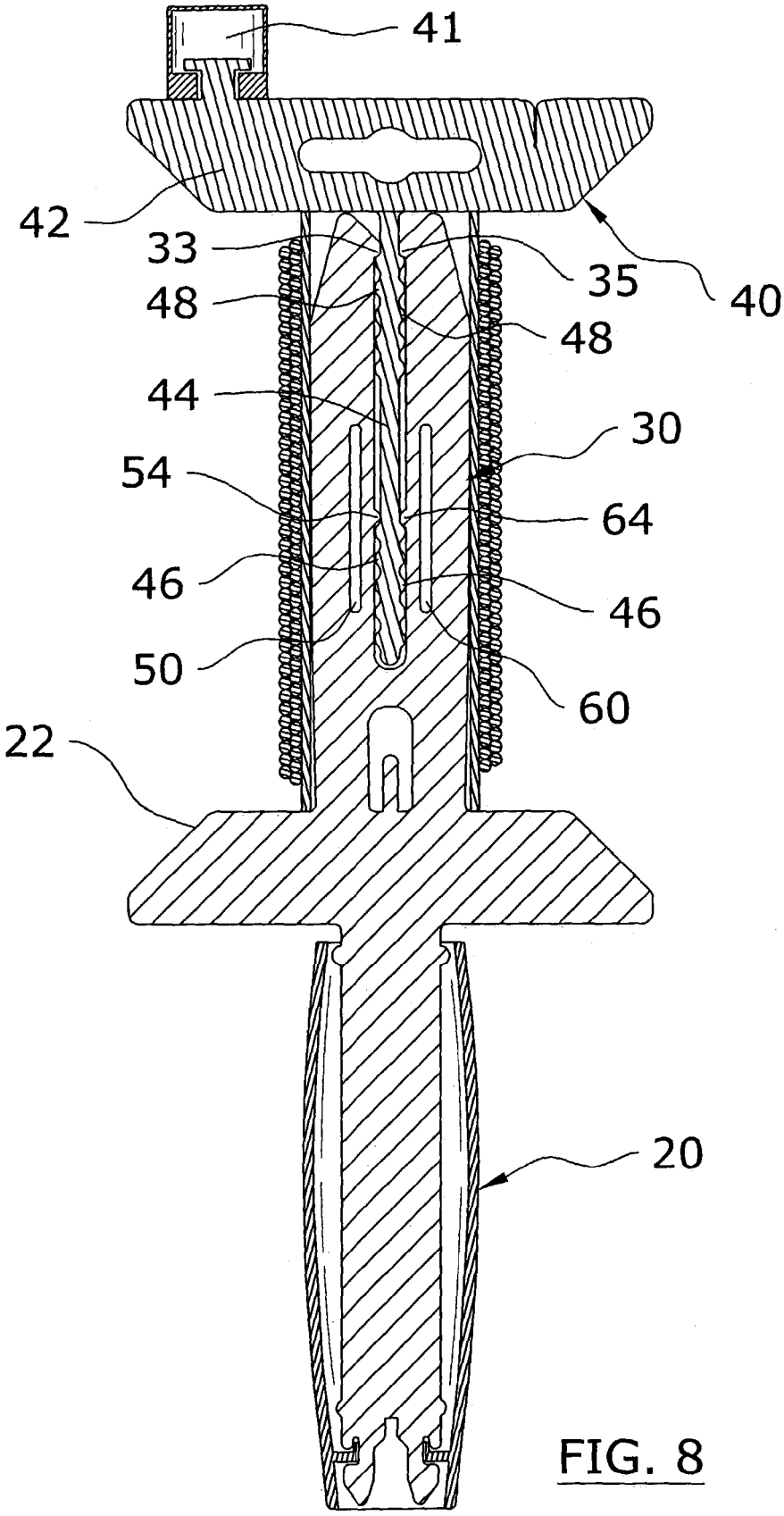
FIG. 8 is a cross sectional view taken along line 8—8 of FIG. 7.

The end shoulder 42 may be comprised of any broad structure capable of retaining a spool 12 on the shank of the present invention as best shown in FIGS. 1 through 9 of the drawings. The end shoulder 42 may have various structures other than that illustrated in the attached figures. An end handle 41 may be attached to the end shoulder 42 in a rotatable or non-rotatable manner for rotating the spool 12 with respect to the handle member 20 as best illustrated in FIG. 9 of the drawings.

Figure 6:
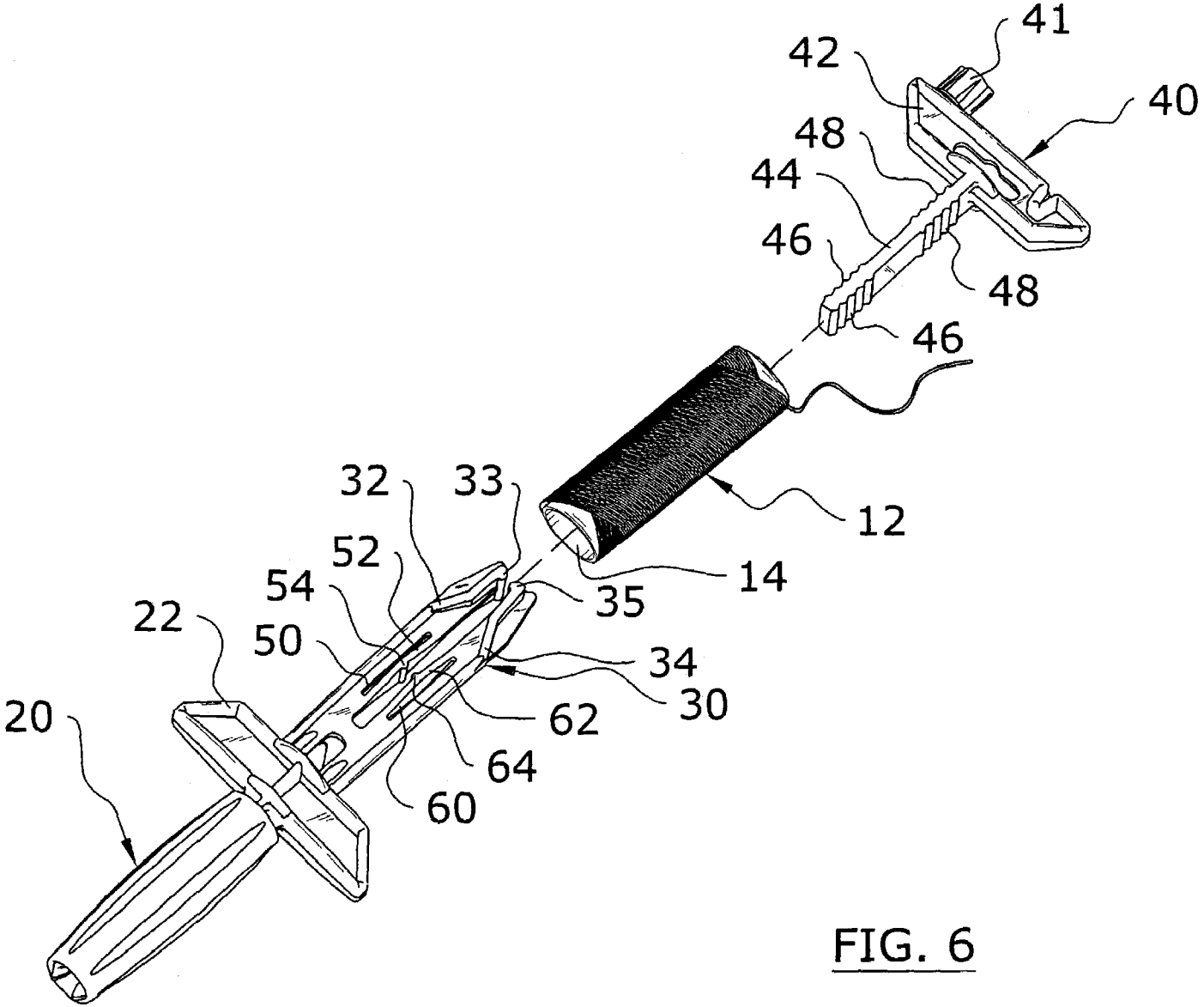
FIG. 6 is an exploded perspective view of the present invention and a disposable spool.

The tongue member 44 preferably has a length sufficient to extend through the core 14 of the spool 12 into engagement with the prongs 32, 34 as best illustrated in FIG. 8 of the drawings. The tongue member 44 preferably is comprised of a flat broad structure as best illustrated in FIGS. 6 and 9 of the drawings. The tongue member 44 may be comprised of various other structures capable of being inserted within prongs 32, 34 though not illustrated in the drawings.

The tongue member 44 preferably has a plurality of teeth 46, 48 on opposing sides of the tongue member 44 for catchably engaging the prongs 32, 34. The plurality of teeth 46, 48 are substantially transverse with respect to a longitudinal axis of the tongue member 44 as best illustrated in FIGS. 6 and 9 of the drawings.

The teeth 46, 48 may have various structures capable of forming raised ridges capable of catchably receiving the prongs 32, 34 such as but not limited to serrated, saw-tooth, curved, triangular, square, rectangular and other related shapes. The teeth 46, 48 are preferably mirrored on opposing sides of the tongue member 44 as shown in FIG. 9 of the drawings.

As further shown in FIG. 9 of the drawings, the plurality of teeth are preferably comprised of a plurality of first teeth 46 and a plurality of second teeth 48 forming two distinct groups of teeth. It can be appreciated that additional groups of teeth may also be formed as desired.

Figure 2:
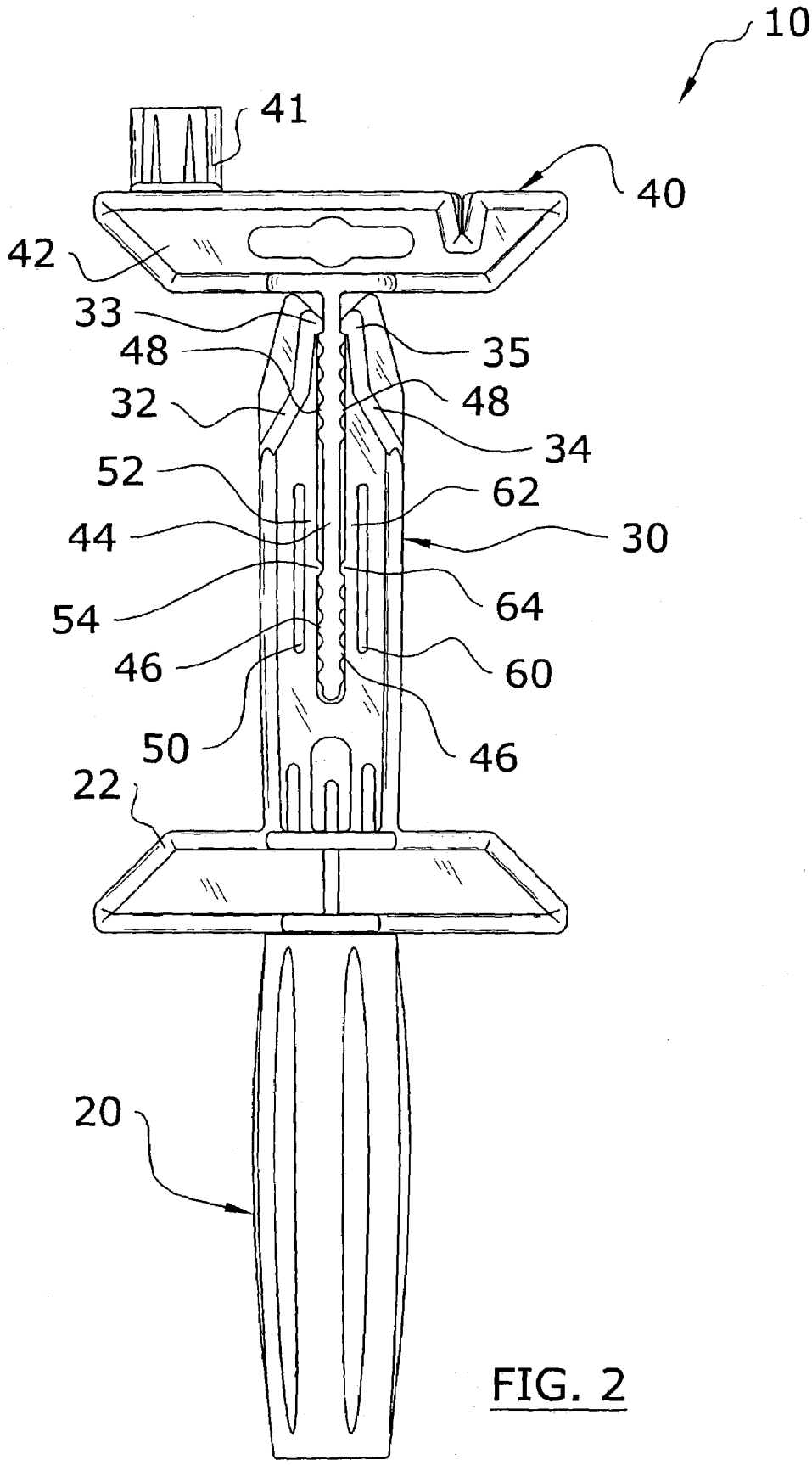
FIG. 2 is a front view of the present invention fully assembled.

The first teeth 46 preferably extend a finite distance from a distal portion of the tongue member 44 as shown in FIG. 9 of the drawings. The second teeth 48 extend from the tongue member 44 between the first teeth 46 and the end shoulder 42 as further shown in FIG. 9 of the drawings. A flat space is preferably positioned between the first teeth 46 and the second teeth 48 as further shown in FIG. 9 of the drawings. The engaging members 33, 35 catchably engage the second teeth 48 and the positive members catchably engage the first teeth 46 as shown in FIGS. 2 and 8 of the drawings.

C. Handle Member

The handle structure is formed for rotatably supporting the shank structure and the spool 12 positioned upon the shank structure. The handle structure may be comprised of various well-known handle configurations suitable for an elongate material dispenser such as a rotatable handle and the like. The handle structure further preferably includes a handle shoulder 22 for providing end support to the spool 12 opposite of the end shoulder 42 as shown in FIGS. 1 through 8 of the drawings.

As shown in FIG. 10 of the drawings, the handle structure has a first prong 32 and a second prong 34 extending from the handle shoulder 22. The first prong 32 and the second prong 34 preferably are connected together at a prong base as shown in FIG. 10 of the drawings, however the first prong 32 and the second prong 34 may be directly connected to the handle member 20 independently without the usage of a prong base.

The first prong 32 and the second prong 34 are preferably comprised of a resilient material and structure so that they define a receiving slot between thereof that receives the tongue member 44 of the end member 40. The receiving slot may have various configurations capable of removably receiving the tongue member 44.

Figure 1:
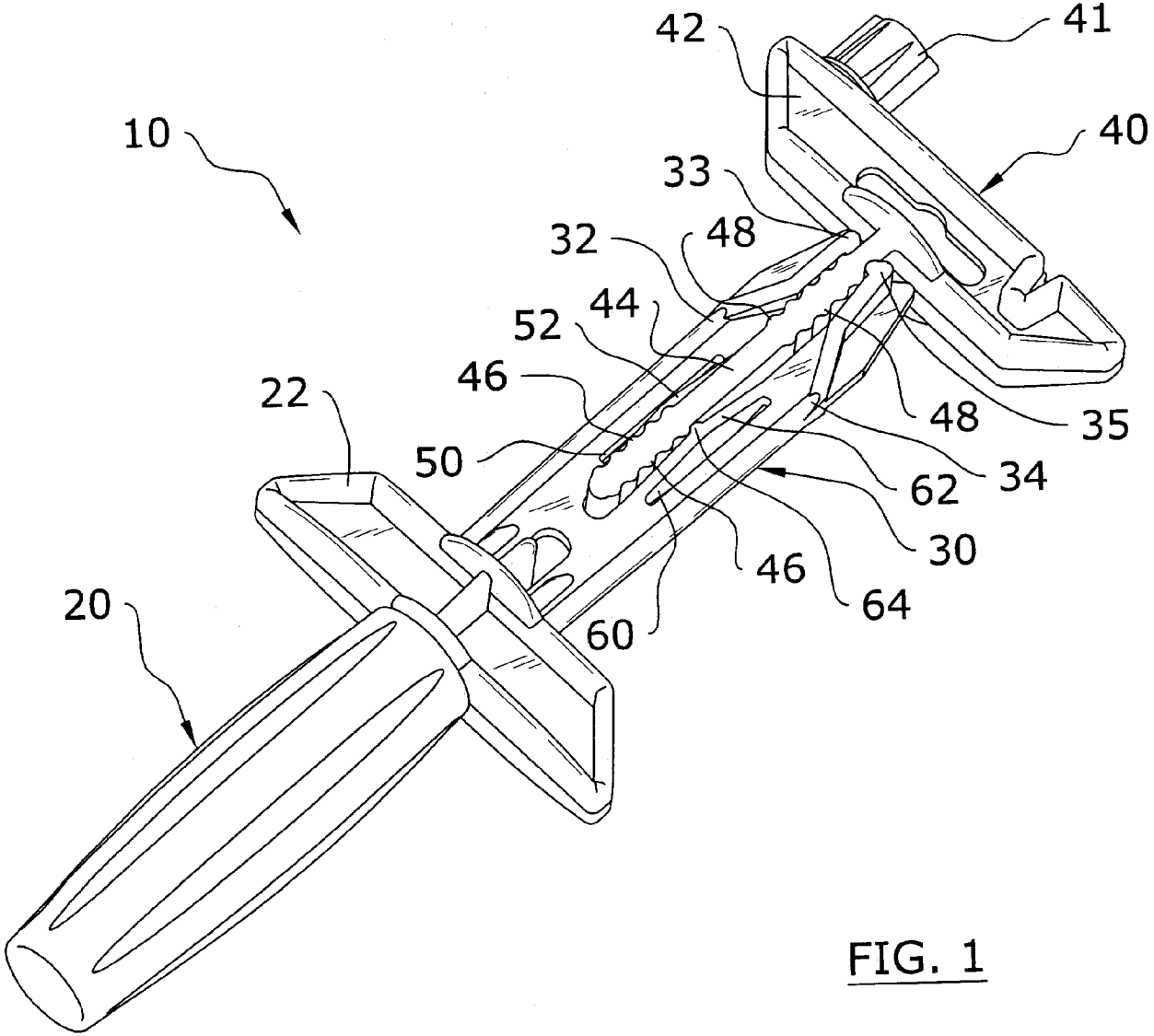
FIG. 1 is an upper perspective view of the present invention fully assembled.

The first prong 32 includes at least one first engaging member 33 near the distal end of the first prong 32 facing inwardly. The first engaging member 33 is a nub-like structure and catchably engages the second teeth 48 as shown in FIGS. 1, 2 and 8 of the drawings.

The first prong 32 further preferably includes at least one first positive member 54 attached to a central portion of the first prong 32 facing inwardly. The first positive member 54 is also a nub-like structure and catchably engages the first teeth 46 as shown in FIGS. 1, 2 and 8 of the drawings.

As best shown in FIG. 10 of the drawings, the first prong 32 includes a first cross member 52 supporting the first positive member 54 and forming a first slot 50 within the first prong 32. The first cross member 52 is comprised of a resilient material and structure. The first cross member 52 and the first slot 50 are preferably substantially aligned in a parallel manner with respect to a longitudinal axis of the first prong 32.

The second prong 34 includes at least one second engaging member 35 near the distal end of the second prong 34 facing inwardly. The second engaging member 35 is a nub-like structure and catchably engages the second teeth 48 as shown in FIGS. 1, 2 and 8 of the drawings.

The second prong 34 further preferably includes at least one second positive member 64 attached to a central portion of the second prong 34 facing inwardly. The second positive member 64 is also a nub-like structure and catchably engages the second teeth 48 as shown in FIGS. 1, 2 and 8 of the drawings.

As best shown in FIG. 10 of the drawings, the second prong 34 includes a second cross member 62 supporting the second positive member 64 and forming a second slot 60 within the second prong 34. The second cross member 62 is comprised of a resilient material and structure. The second cross member 62 and the second slot 60 are preferably substantially aligned in a parallel manner with respect to a longitudinal axis of the second prong 34.

D. Alternative Embodiment

In the alternative embodiment shown in FIG. 11 of the drawings, the handle structure includes the tongue member 44 and the end member 40 has the first prong 32 and the second prong 34. Various other configurations may be utilized to construct the present invention though not shown in the attached drawings.

E. Operation

Figure 3:
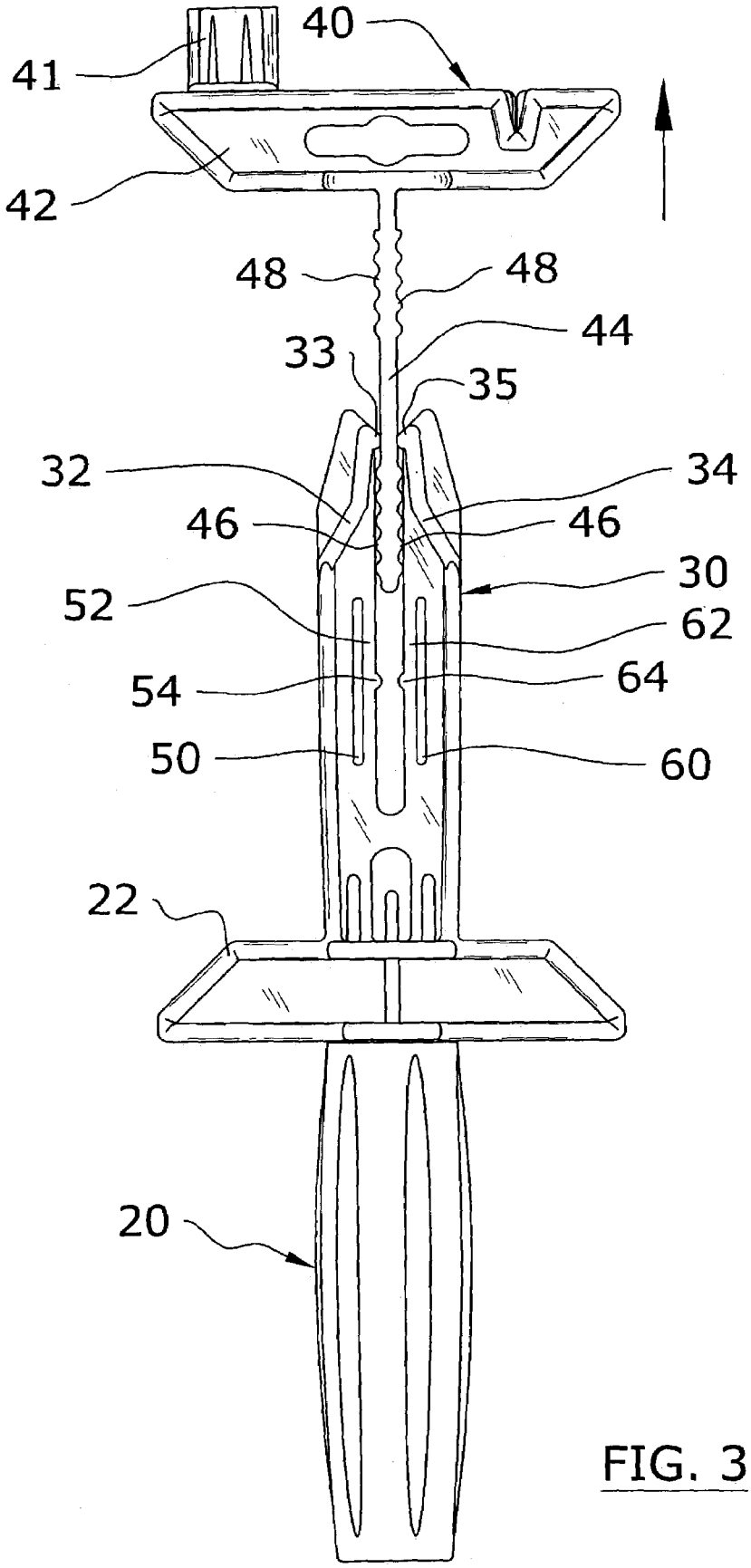
FIG. 3 is a front view of the present invention with the split shank partially separated.

In use, the user first separates the handle member 20 from the end member 40 by pulling the respective components apart. As shown in FIGS. 3 and 4 of the drawings, the tongue member 44 is pulled through the slot between the prongs 32, 34.

The user thereafter positions the core 14 of the spool 12 upon the prongs 32, 34 until properly positioned. The user then inserts the tongue member 44 of the end member 40 into the core 14 until catchably engaged within the prongs 32, 34 as shown in FIGS. 7 and 8 of the drawings.

The positive members 54, 64 maintain a positive contacting force with the first teeth 46 and are less dependent upon the compression force applied by the core 14 of the spool 12 upon the prongs 32, 34 for engagement. Hence, if the core 14 of the spool 12 becomes deteriorated due to repeated usage, becoming wet or the like causing deformation thereof, the positive members 54, 64 will retain a positive engagement with the first teeth 46 as shown in FIG. 8 of the drawings. The above-stated process is simply repeated to replace the spool 12 when desired.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly, and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An elongate material dispenser system, comprising:

an end member including a tongue member extending from an end shoulder, wherein said tongue member has a plurality of teeth on opposing sides; and a handle structure including a first prong and a second prong;

wherein said first prong includes a first engaging member and a first positive member;

wherein said second prong includes a second engaging member and a second positive member;

wherein said engaging members and said positive members catchably engage said teeth;

wherein said first prong includes a first cross member supporting said first positive member and forming a first slot within said first prong, and wherein said second prong includes a second cross member supporting said second positive member and forming a second slot within said second prong.

2. The elongate material dispenser system of claim 1, wherein said positive members are comprised of a nub structure.

3. The elongate material dispenser system of claim 1, wherein said cross members are resilient.

4. The elongate material dispenser system of claim 1, herein said positive members are comprised of a nub structure.

5. The elongate material dispenser system of claim 1, wherein said plurality of teeth are substantially transverse with respect to a longitudinal axis of said tongue member.

6. The elongate material dispenser system of claim 5, wherein said tongue member is comprised of a flat structure.

7. The elongate material dispenser system of claim 1, wherein said tongue member is comprised of a flat structure.

8. The elongate material dispenser system of claim 1, wherein said plurality of teeth are comprised of a plurality of first teeth and a plurality of second teeth, wherein said first teeth extend from a distal portion of said tongue member, wherein said second teeth extend from said tongue member between said first teeth and said end shoulder, and wherein said engaging members catchably engage said second teeth and wherein said positive members catchably engage said first teeth.

9. The elongate material dispenser system of claim 8, wherein said positive members extend inwardly from a central portion of said prongs.

10. An elongate material dispenser system, comprising:

an handle structure including a tongue member extending from a handle shoulder, wherein said tongue member has a plurality of teeth on opposing sides; and an end member including a first prong and a second prong;

wherein said first prong includes a first engaging member and a first positive member;

wherein said second prong includes a second engaging member and a second positive member;

wherein said engaging members and said positive members catchably engage said teeth;

wherein said first prong includes a first cross member supporting said first positive member and forming a first slot within said first prong, and wherein said second prong includes a second cross member supporting said second positive member and forming a second slot within said second prong.

11. The elongate material dispenser system of claim 10, wherein said positive members are comprised of a nub structure.

12. The elongate material dispenser system of claim 10, wherein said cross members are resilient.

13. The elongate material dispenser system of claim 10, herein said positive members are comprised of a nub structure.

14. The elongate material dispenser system of claim 10, wherein said plurality of teeth are substantially transverse with respect to a longitudinal axis of said tongue member.

15. The elongate material dispenser system of claim 14, wherein said tongue member is comprised of a flat structure.

16. The elongate material dispenser system of claim 10, wherein said tongue member is comprised of a flat structure.

17. The elongate material dispenser system of claim 10, wherein said plurality of teeth are comprised of a plurality of first teeth and a plurality of second teeth, wherein said first teeth extend from a distal portion of said tongue member, wherein said second teeth extend from said tongue member between said first teeth and said end shoulder, and wherein said engaging members catchably engage said second teeth and wherein said positive members catchably engage said first teeth.

18. The elongate material dispenser system of claim 17, wherein said positive members extend inwardly from a central portion of said prongs.

* * * * *